US011508541B2

(12) United States Patent
Huettinger et al.

(10) Patent No.: US 11,508,541 B2
(45) Date of Patent: Nov. 22, 2022

(54) FUSE HAVING AN INTEGRATED MEASURING FUNCTION, AND FUSE BODY

(71) Applicant: Siemens Aktiengesellschaft, Munich (DE)

(72) Inventors: Robert Huettinger, Schoefweg (DE); Jean-Mary Martel, Tegernheim (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 17/414,586

(22) PCT Filed: Dec. 18, 2019

(86) PCT No.: PCT/EP2019/085955
§ 371 (c)(1),
(2) Date: Jun. 16, 2021

(87) PCT Pub. No.: WO2020/127486
PCT Pub. Date: Jun. 25, 2020

(65) Prior Publication Data

US 2022/0059307 A1 Feb. 24, 2022

(30) Foreign Application Priority Data

Dec. 20, 2018 (DE) ..... 102018222560.5

(51) Int. Cl.
*H01H 85/175* (2006.01)
*H01H 85/055* (2006.01)
(Continued)

(52) U.S. Cl.
CPC ..... *H01H 85/055* (2013.01); *H01H 85/165* (2013.01); *H01H 85/175* (2013.01);
(Continued)

(58) Field of Classification Search
CPC .. H01H 85/055; H01H 85/165; H01H 85/175; H01H 85/1755; H01H 2085/0266; H01H 2085/0275; H01H 2085/0291
See application file for complete search history.

(56) References Cited

U.S. PATENT DOCUMENTS

2005/0231320 A1* 10/2005 Ackermann ..... H01H 85/30 337/206
2008/0042796 A1 2/2008 Moffat
(Continued)

FOREIGN PATENT DOCUMENTS

DE 19523725 C2 6/1997
DE 102014205871 A1 10/2015
(Continued)

OTHER PUBLICATIONS

PCT International Search Report dated Feb. 21, 2020 corresponding to PCT International Application No. PCT/EP2019/085955 filed Dec. 18, 2019.
(Continued)

*Primary Examiner* — Jacob R Crum
(74) *Attorney, Agent, or Firm* — Harness, Dickey & Pierce, P.L.C.

(57) ABSTRACT

A fuse includes an integrated measuring function. In an embodiment, the fuse includes a fuse housing which in turn has a first receiving space delimited by a pressure body and a second receiving space which is spatially separated from the first receiving space and is delimited by a protective body, the first and second receiving spaces being arranged one behind the other in a direction of longitudinal extent. A fusible conductor is accommodated and mounted in the first receiving space and a measuring device is accommodated and mounted in the second receiving space. The measuring device has a current transformer and an electronic assembly which is electrically conductively connected to the current transformer. The current transformer and the electronic assembly are arranged one behind the other in the direction of longitudinal extent.

22 Claims, 5 Drawing Sheets

(51) Int. Cl.
*H01H 85/165* (2006.01)
*H01H 85/02* (2006.01)

(52) U.S. Cl.
CPC . *H01H 85/1755* (2013.01); *H01H 2085/0266* (2013.01); *H01H 2085/0275* (2013.01); *H01H 2085/0291* (2013.01)

(56) References Cited

U.S. PATENT DOCUMENTS

| | | | | |
|---|---|---|---|---|
| 2013/0335188 | A1* | 12/2013 | Faltermeier | H01H 85/20 337/283 |
| 2015/0301111 | A1 | 10/2015 | Bruchmann | |
| 2016/0035529 | A1* | 2/2016 | Durth | H01T 1/14 337/18 |
| 2018/0331571 | A1 | 11/2018 | Smit | |

FOREIGN PATENT DOCUMENTS

| | | | |
|---|---|---|---|
| DE | 102016211621 | A1 | 12/2017 |
| EP | 0917723 | B1 | 3/2000 |
| EP | 1116252 | B1 | 7/2002 |
| EP | 2423693 | A1 | 2/2012 |
| EP | 2885800 | A1 | 6/2015 |
| EP | 3026445 | B1 | 8/2017 |
| JP | H11273544 | A | 10/1999 |
| JP | 2018163052 | A | 10/2018 |
| WO | WO 2017078525 | A1 | 5/2017 |

OTHER PUBLICATIONS

Written Opinion of International Searching Authority dated Feb. 21, 2020 corresponding to PCT International Application No. PCT/EP2019/085955 filed Dec. 18, 2019.

German Office Action for German Application No. 10 2018 222 560.5 dated Oct. 18, 2019.

* cited by examiner

RELATED ART

FUSE HAVING AN INTEGRATED MEASURING FUNCTION, AND FUSE BODY

PRIORITY STATEMENT

This application is the national phase under 35 U.S.C. § 371 of PCT International Application No. PCT/EP2019/085955 which has an International filing date of Dec. 18, 2019, which claims priority to German patent application DE 102018222560.5 filed Dec. 20, 2018, the entire contents of each of which are hereby incorporated herein by reference.

FIELD

The application generally relates to a fuse in which a measuring function is integrated; and/or to a fuse body for a fuse having an integrated measuring function.

BACKGROUND

Conductors through which an electric current flows heat up. In the case of impermissibly high currents, this may result in impermissibly severe heating of the conductor and, as a result, in melting of the insulation surrounding the conductor, which may consequently lead to damage as severe as a cable fire. In order to prevent this fire risk, in the event of an occurrence of an excessively high electric current, that is to say an overload current or a short-circuit current, this electric current has to be promptly disconnected. This is ensured using what are known as overcurrent protection devices.

One example of such an overcurrent protection device is, for example, a fuse that interrupts the circuit due to the melting of one or more fusible elements when the current intensity of the circuit secured by the fuse exceeds a particular value over a particular period of time. The fuse includes an insulating body which has two electrical terminals that are electrically conductively connected to one another by one or more fusible elements inside the insulating body. The fusible element, which has a reduced cross section in comparison with the rest of the conductors in the circuit, is heated by the current flowing through it and melts when the critical rated current of the fuse is significantly exceeded for a predetermined period of time. Ceramic is mostly used as the material for the insulating body on account of its good insulation properties. The use of a fuse in this manner is already known in principle for example from European patent document EP 0 917 723 B1 or from German laid-open documents DE 10 2014 205 871 A1 and DE 10 2016 211 621 A1.

Fuses of various structural types are available. In addition to simple device fuses, which have a simple glass cylinder in which the fusible element is received, there are also structures in which the ceramic body is filled with sand—mainly quartz sand: in this case, a distinction is drawn between types with solidified and with unsolidified quartz sand. In the case of a fuse solidified with sand, the fusible element is surrounded by quartz sand. In this case, the housing of the fuse is generally formed by a ceramic body in which the solidified sand, the electrical terminals and the fusible element are received or held. Here, the quartz sand functions as an arc-extinguishing medium: if the rated current of the fuse is significantly exceeded—for example on account of a high short-circuit current—then this leads to the fuse being stressed, during which stress the fusible element first of all melts and then evaporates on account of the high temperature development. This gives rise to an electrically conductive plasma by way of which the current flow between the electrical terminals is first of all maintained—an arc forms. Since the metal vapor of the evaporated fusible element precipitates on the surface of the grains of quartz sand, the arc is in turn cooled. As a result, the resistance inside the fuse insert increases in such a way that the arc is ultimately extinguished. The electrical line to be protected by the fuse is thus interrupted.

Low-voltage high-power fuses, what are known as NH fuses, but also semiconductor fuses, what are known as HLS fuses, as are marketed for example under the product name SITOR, are already known in principle from the prior art in the field of fuses.

In the case of NH fuses, one or more fusible elements in the form of metal strips are normally used. In this case, the fusible elements mostly have what are known as rows of narrow points in order to selectively disconnect the fuse.

Furthermore, at least one solder deposit may be applied to one or more of the fusible elements, by way of which solder deposit the overload characteristic of the fuse can be influenced. The critical permitted power value I2t for the disconnection behavior of the fuse is relatively high in the case of NH fuses, as a result of which these have a somewhat more lethargic characteristic.

If the fusible element is heated by an electric overload current to a temperature that lies above the melting point of the solder, this solder then diffuses into the fusible element material and forms an alloy with it. The electrical resistance of the fusible element thereby increases, this leading to further heating thereof, as a result of which the diffusion process is accelerated further until the fusible element has completely dissolved into the surroundings of the solder deposit, such that it breaks off, as a result of which the current flow is interrupted. In the case of a brief, permissible overcurrent, premature disconnection by way of the NH fuse does not take place. If a short-circuit current occurs, by contrast, the fusible element tears off at the rows of narrow points. As a result, a plurality of small arcs that are connected in series arise at the same time, the voltages of which arcs add up and thus lead to quicker disconnection of the fuse. NH fuses serve, for example, to protect installations or switchgear cabinets from fire, for example caused by overheated connection lines.

On the part of the operators of electrical installations, there is an increasing desire to be able to determine the state of an electrical installation in a timely fashion. In the past, this was often carried out by way of a visual check—in the case of fuses, for example, in that the fuses are equipped with an indicator that optically signals tripping of the respective fuse externally on the housing of the fuse in question. For the future, however, it is increasingly required to be able to query this information at any time and as far as possible in a manner independent of location, for example from a control station. For this reason, electrical installation devices are increasingly being designed so as to provide information about their operating state. Electrical switching devices, for example fire protection switches, which already have dedicated control logic, can be designed with relatively little expenditure so as to prepare and provide corresponding information.

In the case of fuses, there are corresponding solutions involving recording and forwarding the "triggered" information, provided optically by the indicator, by way of a communication module which can be attached to the fuse. However, attachable solutions have the disadvantage that they require additional installation space and therefore can be used only with relatively high expenditure in pre-existing installations. For a simple retrofit use, in which an existing fuse of conventional design without a communication module is replaced by a new fuse having a corresponding communication module for the purpose of retrofitting in or modernizing the installation, these attachable solutions are often not used since the additional installation space required therefor is not available.

To solve this problem of limited installation space, which occurs especially in the case of retrofit applications, international patent application WO 2017/078525 A1 describes a fuse in which a current sensor is integrated into the pressure body of the fuse. By way of this current sensor, the current flow through the fuse occurring during normal operation can be measured and transmitted to a querying unit arranged outside the fuse.

SUMMARY

However, the inventors have discovered that since comparatively high temperatures may also occur in a fuse, it is questionable as to how reliably a sensor integrated into the pressure body of the fuse functions over the service life of the fuse.

The embodiments of the invention therefore provide a fuse and a fuse body which at least partly overcome the abovementioned problems.

At least one embodiment of the invention is directed to a fuse and/or a fuse body. Advantageous configurations of the fuse according to the invention and of the fuse body according to the invention are the subject matter of the claims.

The fuse according to at least one embodiment of the invention has an integrated measuring function has a fuse housing which, for its part, has a first receiving space bounded by a pressure body and a second receiving space physically delimited from the first receiving space and bounded by a protective body, which first and second receiving spaces are arranged one behind the other in a direction of longitudinal extent. In this case, a fusible element is accommodated and mounted in the first receiving space and a measuring device is accommodated and mounted in the second receiving space. The measuring device has a current transformer and an electronics assembly electrically conductively connected to the current transformer, wherein the current transformer and the electronics assembly are arranged one behind the other in the direction of longitudinal extent.

The fuse body according to at least one embodiment of the invention for a fuse of at least one embodiment has a first section which is designed as a pressure body which bounds the first receiving space for receiving the fusible element, and a second section which is designed as a protective body which bounds the second receiving space for receiving the measuring device. In this case, the first receiving space and the second receiving space are arranged physically delimited from one another and one behind the other in a direction of longitudinal extent in the fuse body.

BRIEF DESCRIPTION OF THE DRAWINGS

Two example embodiments of the fuse are explained in more detail below with reference to the appended figures. In the figures.

In the various figures of the drawing, identical parts are always provided with the same reference sign. The description applies to all of the drawing figures in which the corresponding part can likewise be seen.

DETAILED DESCRIPTION OF THE EXAMPLE EMBODIMENTS

Figure 1:
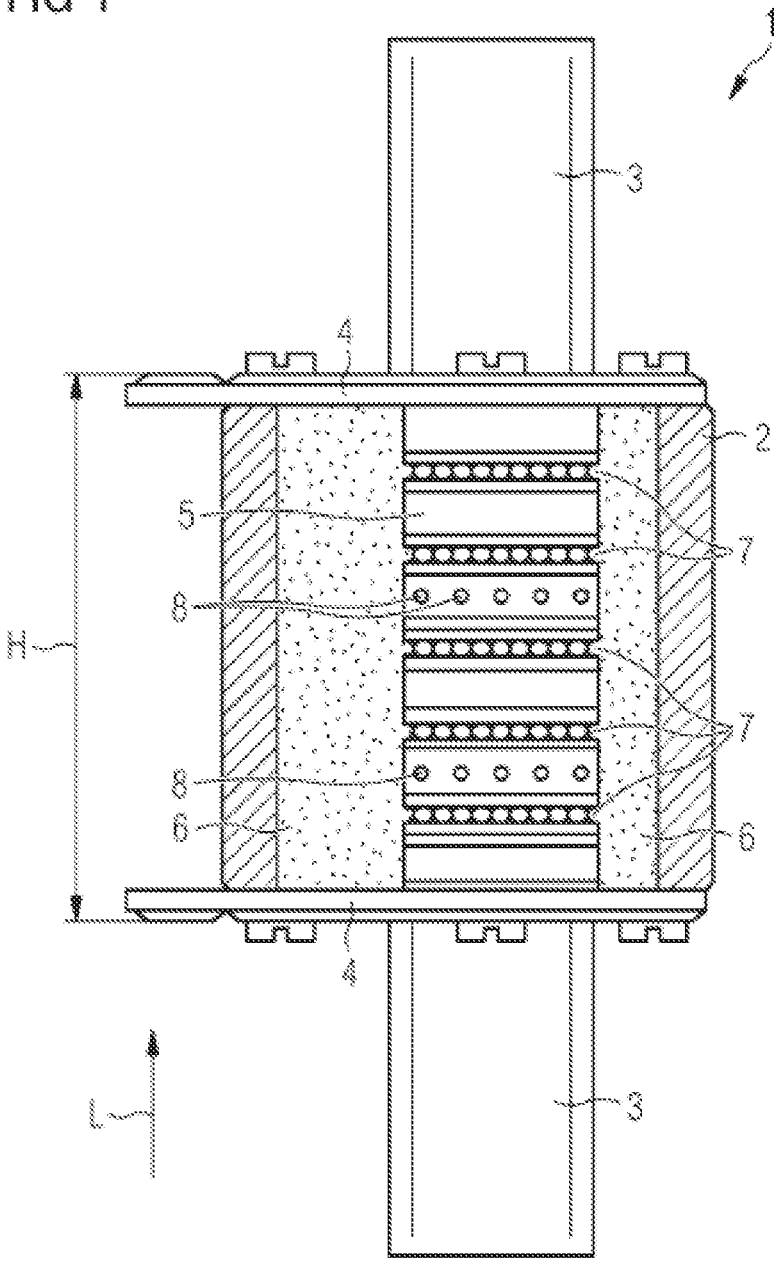
FIG. 1 is a schematic illustration of an NH fuse known from the prior art.

The fuse according to at least one embodiment of the invention has an integrated measuring function has a fuse housing which, for its part, has a first receiving space bounded by a pressure body and a second receiving space physically delimited from the first receiving space and bounded by a protective body, which first and second receiving spaces are arranged one behind the other in a direction of longitudinal extent. In this case, a fusible element is accommodated and mounted in the first receiving space and a measuring device is accommodated and mounted in the second receiving space. The measuring device has a current transformer and an electronics assembly electrically conductively connected to the current transformer, wherein the current transformer and the electronics assembly are arranged one behind the other in the direction of longitudinal extent.

With the aid of the measuring device, it becomes possible to identify the electric current flowing through the fuse directly at the fuse. In this case, the first and the second receiving space are arranged one behind the other in a direction of longitudinal extent L of the fuse, that is to say in an axial direction. In this case, the pressure body serves to absorb the pressure occurring when the fuse is heated or tripped. Stringent requirements are therefore placed on the mechanical strength and stability of the protective housing. In contrast thereto, only one protective housing is necessary to delimit the second receiving space in order to receive and to fasten the measuring device and to protect it against external disruptions such as moisture and/or dirt. Considerably less stringent requirements are therefore placed on the mechanical stability of this housing.

In this case, the current transformer arranged in the second receiving space serves firstly as a current sensor which forwards the detected current measurement values to the electronics assembly, where the measurement values are processed further. Secondly, the energy required for this is likewise generated with the aid of the current transformer by electromagnetic induction from the primary current, that is to say the operating current of the fuse. The current transformer therefore also serves as an energy source for the electronics assembly. In order to provide sufficient energy for the electronics assembly even in the case of low operating currents of the fuse and therefore to ensure the reliability of the measuring device, the current transformer has to be dimensioned to be relatively large for this purpose.

At the same time, the fuse has to be kept compact in order to also be able to be used for retrofit applications in the context of retrofitting in or modernizing existing systems, in which a conventional fuse without a measuring apparatus is replaced. Since the fuse ideally has the dimensions of a standardized NH fuse in this case, the second receiving space in which the measuring device is received and mounted, in particular in the axial direction, that is to say in the direction of longitudinal extent L, is severely limited.

The second receiving space can be kept compact owing to the arrangement of the current transformer and the electronics assembly one behind the other in the axial direction, that is to say in the direction of longitudinal extent.

In an advantageous development of the fuse, the electronics assembly is arranged between the current transformer and a closure element of the fuse.

In principle, there are two options for arranging the current transformer and the electronics assembly one behind the other in the direction of longitudinal extent: either the electronics assembly is arranged between the current transformer and the pressure housing or between the current transformer and the closure element. The latter option has the advantage that the electronics assembly that is sensitive in comparison to the current transformer is arranged further remote from the pressure housing of the fuse, so that when the fuse is tripped, the associated increase in pressure and temperature does not have a direct effect on the electronics assembly. As a result, the probability of the electronics system failing can be reduced.

In a further advantageous development of the fuse, the current transformer almost completely fills the second receiving space in a radial direction oriented orthogonally in relation to the direction of longitudinal extent.

In order to be able to arrange a current transformer that is as large as possible in the second receiving space, the electronics assembly and the current transformer are arranged one behind the other in the axial direction, that is to say in the direction of longitudinal extent. In this way, the current transformer can be dimensioned such that it almost completely fills the available second receiving space in the radial direction. The volume of the current transformer can therefore be optimized to the effect that the energy provided for the electronics assembly is as high as possible. In this way, it is possible to construct a fuse having an integrated measuring function which does not require an external energy source for supplying energy to the measuring device.

In a further advantageous development of the fuse, the electronics assembly has a printed circuit board. In order to meet the requirements of a design of the measuring apparatus in as compact a manner as possible together with as large a current transformer volume as possible, it is necessary for the electronics assembly to be designed in as compact a manner as possible too. This is possible by means of a printed circuit board that is kept compact, for example by way of using integrated circuits.

In a further advantageous development of the fuse, the electronics assembly is designed in a disk-like manner in such a way that the height of the electronics assembly together with the height of the current transformer corresponds substantially to the height of the second receiving space.

The disk-like construction allows a flat design of the electronics assembly, as a result of which the measuring device—and therefore the second receiving space and the protective housing surrounding it—can be kept as compact as possible in the axial direction. In a radial direction which is oriented orthogonally in relation to the axial direction, the electronics assembly can in this case take up the entire width of the second receiving space as far as the bounding inner wall of the protective housing.

In a further advantageous development of the fuse, the electronics assembly is designed in a ring-like manner, with an outer radius and with an opening with an inner radius for leading a connection element of the fuse through. Owing to the ring-like design, the electronics assembly can be adapted to the outline of the current transformer. In this case, the outer radius can be selected such that it corresponds substantially to the radius of the current transformer. A compact construction of the measuring device can be realized in this way.

In a further advantageous development of the fuse, the ring-like shape of the electronics assembly (122) is not closed. If the electronics assembly can be designed in a correspondingly compact manner, an open construction—for example in the form of a C or a semicircle—is likewise possible.

In a further advantageous development of the fuse, the electronics assembly has a transmission device in order to transmit a measurement signal detected by the measuring device to a reception device arranged outside the fuse.

With the aid of the transmission device, the ascertained measurement data or else further-processed data based on said measurement data can be transmitted to an external unit, for example a data collection device or a control station. In this way, it is possible to be able to ascertain the operating state of the fuse at any time, without a technician or installer who inspects the fuse on site being required for this purpose.

In a further advantageous development of the fuse, the measurement signal is transmitted by the transmission device to the reception device in a wireless manner.

Wireless transmission of the data to the external reception device significantly simplifies the expenditure on installation of the fuse. For the wireless transmission of the data—measurement values or preprocessed data based on measurement values—by the transmission device to the reception device, common transmission methods such as Bluetooth, RFID (both active and passive), Zigbee, etc. come into consideration, for example. The energy required for the transmission is advantageously obtained here again with the aid of the current transformer by electromagnetic induction from the primary current.

In a further advantageous development of the fuse, the overall installation space required for the fuse corresponds to the installation space of a standardized NH fuse.

By virtue of the fuse according to the invention having an integrated measuring function corresponding in terms of its installation size to the size of a conventional NH fuse, said fuse can also be used for retrofit applications in the context of retrofitting in or modernizing existing systems in which a conventional fuse without a measuring apparatus is replaced with a fuse having an integrated measuring function.

The fuse body according to at least one embodiment of the invention, for a fuse of at least one embodiment, has a first section which is designed as a pressure body which bounds the first receiving space for receiving the fusible element, and a second section which is designed as a protective body which bounds the second receiving space for receiving the measuring device. In this case, the first receiving space and the second receiving space are arranged physically delimited from one another and one behind the other in a direction of longitudinal extent in the fuse body.

In this case, the first section of the fuse body is designed in a pressure-stable manner, that is to say to receive the pressure occurring when the fuse is tripped and therefore constitutes the actual pressure body of the fuse, while the second section merely constitutes a protective function for the measuring apparatus with significantly less stringent requirements being placed on the mechanical stability and strength thereof. The different mechanical strength properties of the two sections can be realized by means of a suitable manufacturing method, for example a 3D printing method. In this case, the first and the second section form one structural unit, that is to say the two sections do not have to be assembled first upon exchange or assembly of the fuse but they are already fixedly connected to one another, as a result of which the expenditure on assembly is significantly simplified.

In an advantageous development, the fuse body is designed in one piece. In particular with respect to the production of the fuse body with the aid of an additive manufacturing process, colloquially also referred to as "3D printing", a one-piece design of the fuse body is advantageous since this avoids subsequent assembly steps. The assembly costs can be further reduced as a result.

In a further advantageous development, the fuse body is formed from a ceramic material or a thermostable plastic. Ceramic materials are particularly suitable for producing a fuse body on account of their high pressure resistance. Thermostable plastics, provided that they are sufficiently thermally stable, are distinguished by contrast by their simplified processability with comparatively low production costs at the same time.

In a further advantageous development, the fuse body is the fuse body is designed in multiple parts, wherein the pressure body is fixedly but detachably connected to the protective body. This results in the advantage that, after the fuse has tripped, the second receiving space in which the measuring apparatus is received can potentially be reused. This is of particular interest when the material costs and manufacturing costs of the measuring device are comparatively high in comparison with the rest of the fuse.

In a further advantageous development of the fuse body, the pressure body and the protective body are formed from different materials. The two receiving spaces can be adapted to the different requirements respectively placed on them by selecting suitable materials for the pressure body and the protective body.

In a further advantageous development of the fuse body, the pressure body and the protective body are surrounded by an additional sleeve. With the aid of the additional sleeve, which may also consist of paper or a plastic coating for example, the structural unit of the fuse body is accentuated. Furthermore, in multiple-part constructions, the disassembly by unauthorized third parties is prevented or at least indicated.

In a further advantageous development of the fuse body, the overall installation space required for the fuse corresponds to the installation space of a standardized NH fuse. As a result, the fuse body can also be used for retrofit fuses, that is to say as a replacement for a conventional fuse without a measuring function.

FIG. 1 schematically shows the basic structure of a standardized NH fuse, as is already previously known from the prior art. The fuse 1 has two connection elements 3 which consist of an electrically conductive material, for example copper. In the illustrations, the connection elements 3 are designed as blade contacts—but this is not essential to the invention. The connection elements 3 are fixedly and tightly mechanically connected to a protective housing 2 with the height H that includes a solid, non-conductive and as far as possible heat-resistant material, for example of a ceramic, and serves as a pressure body for the fuse 1. The protective housing 2 generally has a tubular or hollow-cylindrical basic shape and is externally closed in a pressure-tight manner, for example with the aid of two closure caps 4. In this case, the connection elements 3 each extend through an opening formed in the closure caps 4 into the cavity of the protective housing 2. At least one what is known as fusible element 5 that electrically conductively connects the two connection elements 3 to one another is arranged in this cavity.

The rest of the cavity is for the most part completely filled with an extinguishing medium 6 that serves to extinguish and cool the fuse 1 when it is tripped and completely surrounds the fusible element 5. The extinguishing medium 6 used is, for example, quartz sand. Instead of the one fusible element 5 illustrated in FIG. 1, it is likewise possible to arrange a plurality of fusible elements 5 electrically connected in parallel to one another in the protective housing 2, and accordingly to make contact with the two contact elements 3. The trip characteristic curve—and therefore the trip behavior of the fuse 1 can be influenced by the type, number, arrangement and design of the fusible elements 3.

The fusible element 5 generally includes a highly conductive material, such as copper or silver, and has a plurality of rows of narrow points 7 and one or more solder deposits 8—what are known as solder points—over its length, that is to say in its direction of longitudinal extent L. The trip characteristic curve of the fuse 1 can likewise be influenced and adapted to the respective application by means of the rows of narrow points 7 and the solder points 8. In the case of currents that are lower than the rated current of the fuse 1, only so much power loss is converted in the fusible element 5 that said power loss can be quickly output to the outside in the form of heat by way of the extinguishing sand 6, the protective housing 2 and the two connection elements 3. The temperature of the fusible element 5 in this case does not increase beyond its melting point. If a current that lies in the overload range of the fuse 1 is flowing, then the temperature inside the fuse 1 continuously further increases until the melting point of the fusible element 5 is exceeded and this melts through one of the rows of narrow points 7. In the case of high fault currents—as occur for example due to a short circuit—so much power is converted in the fusible element 5 that this is heated practically over the entire length and consequently melts at all of the rows of narrow points 7 at the same time.

Since liquid copper or silver still has good electrically conductive properties, the flow of current is not yet interrupted at this time. The melt formed from the fusible element 5 is therefore heated further until it finally transitions into the gaseous state, as a result of which a plasma forms. An arc occurs in the process so as to further maintain the current flow across the plasma. In the last stage of a fuse disconnection, the conductive gases react with the extinguishing medium 6, which for the most part includes quartz sand in the case of conventional fuses 1. This is melted due to the extremely high temperatures, brought about due to the arc, in the environment of the arc, which leads to a physical reaction of the molten fusible element material with the surrounding quartz sand 6. Since the reaction product occurring in this case is not electrically conductive, the current flow between the two connection elements 3 quickly drops to zero. In this case, however, it should be borne in mind that a specific mass of fusible element material also requires a corresponding mass of extinguishing medium. Only in this way is it possible to ensure that there is still enough extinguishing medium 6 present at the end of the fuse disconnection to effectively bind all of the conductive plasma.

Figure 2:
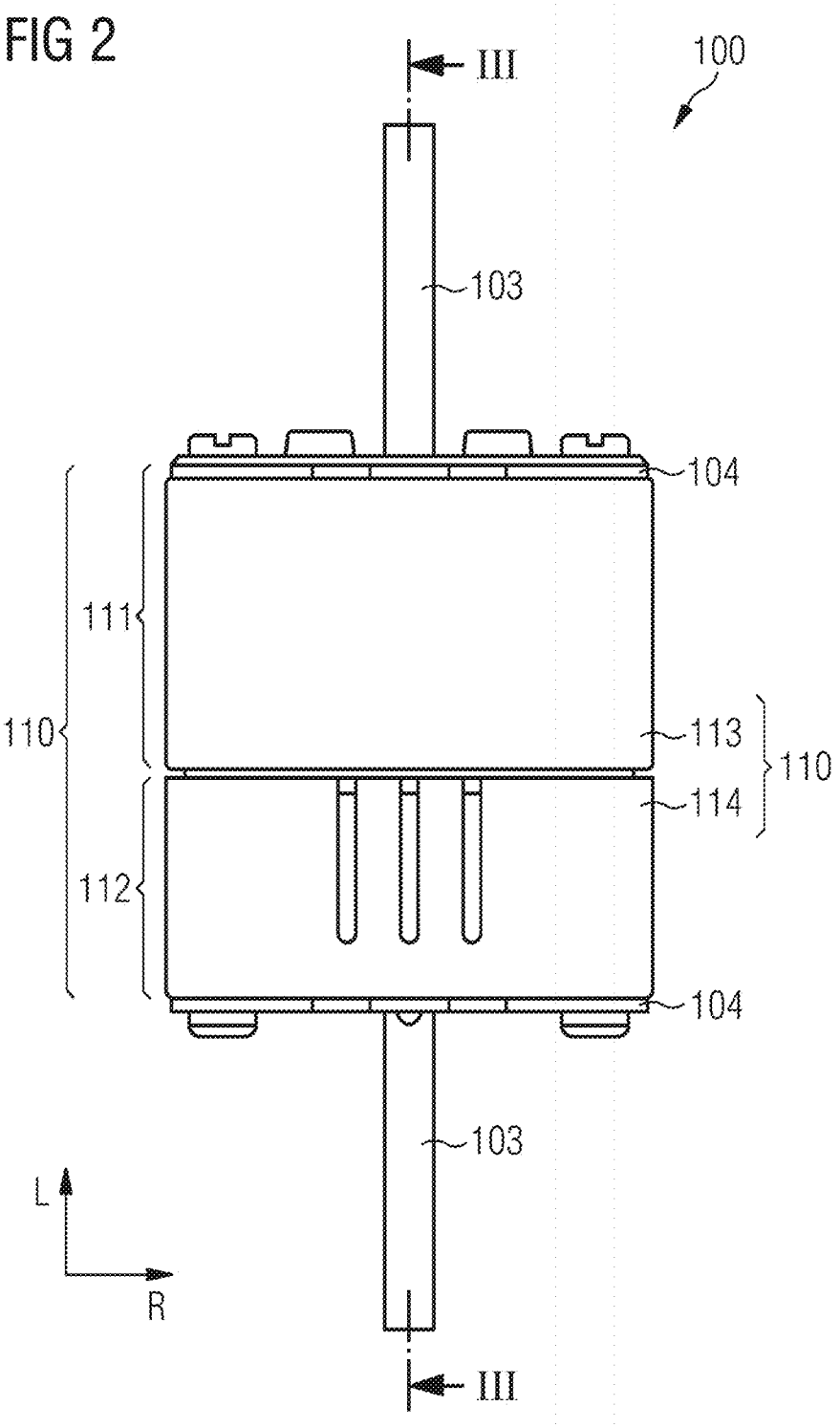
FIGS. 2 to 5 are schematic illustrations of a first example embodiment of the fuse according to the invention in various views.
Figure 3:
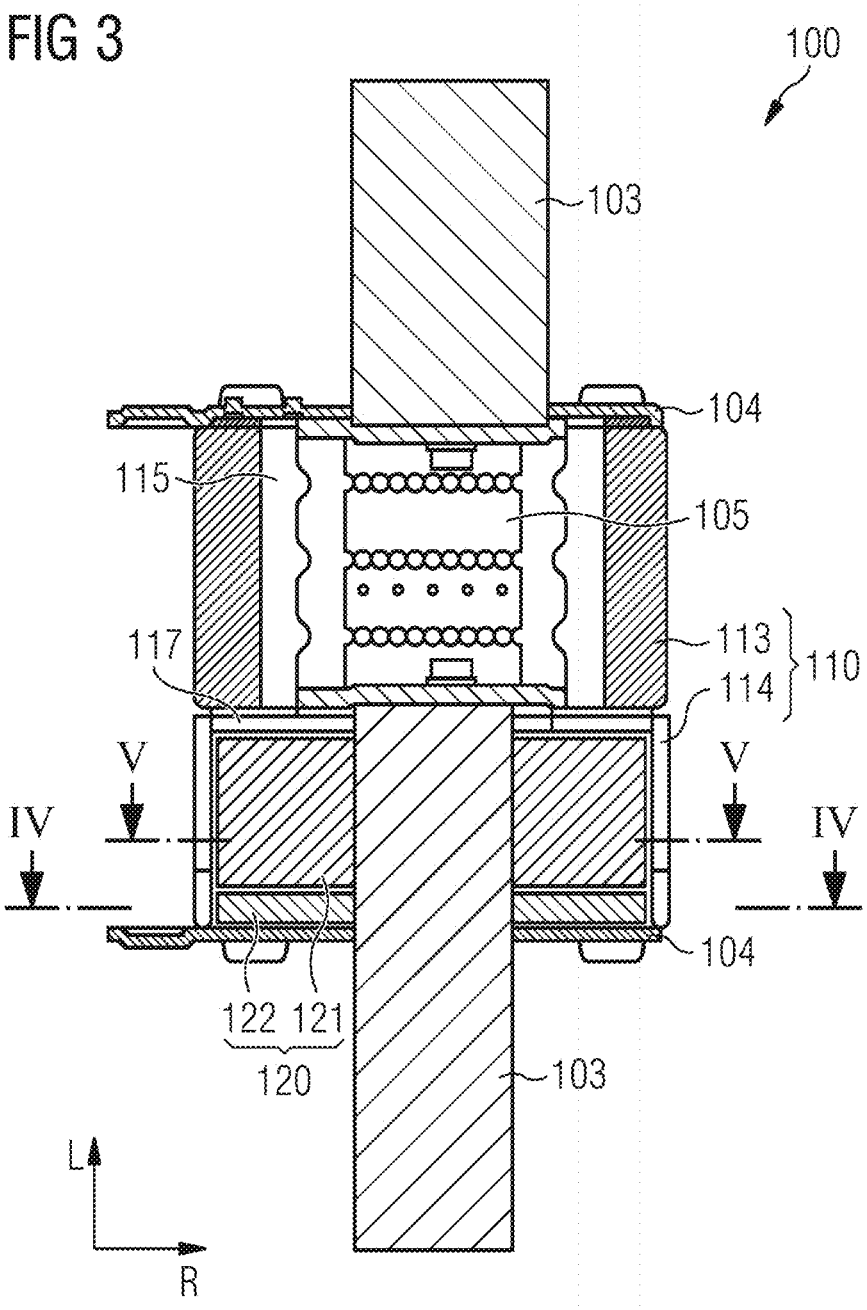
Figure 4:
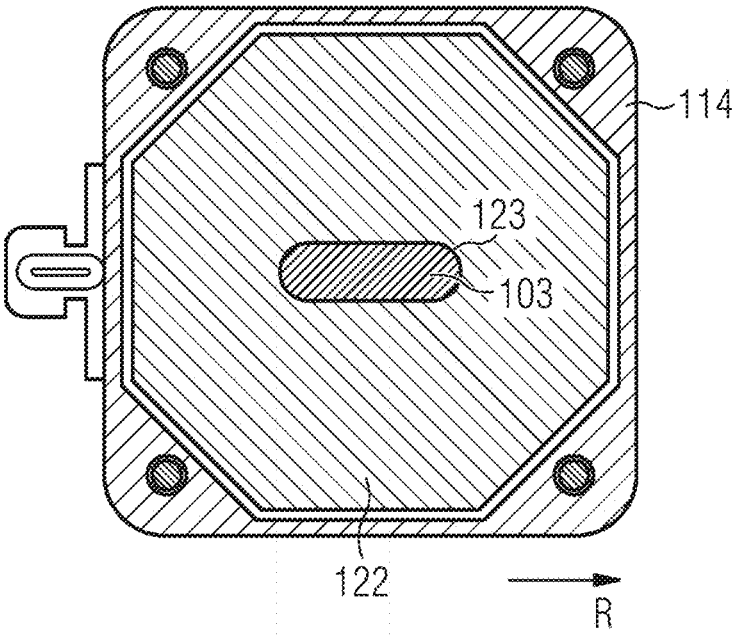
Figure 5:
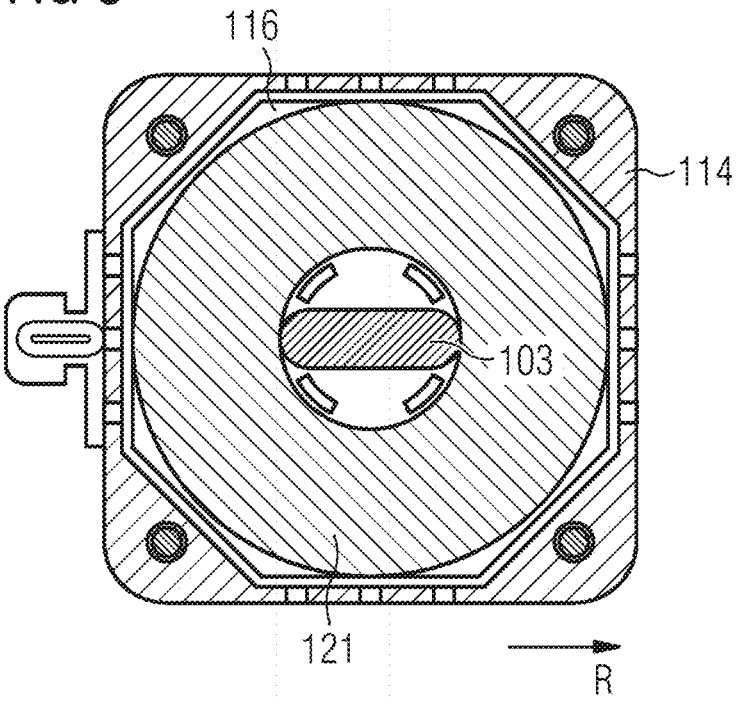

FIGS. 2 to 4 schematically illustrate a first example embodiment of the fuse 100 according to the invention. FIG. 2 shows a side view of the fuse 100; FIGS. 3, 4 and 5 show corresponding sectional illustrations of the fuse 100 in horizontal and vertical projection. The fuse 100 has a fuse housing 110 having a first section 111 and a second section 112 which are arranged one behind the other in a direction of longitudinal extent L of the fuse 100. In this case, the first section 111 is designed as a pressure body 113 for receiving a fusible element 105. The pressure body 113 serves to absorb the pressure occurring when the fuse 100 is heated or tripped, for which reason stringent requirements are placed on the mechanical strength and stability of the pressure body 113. Therefore, a first receiving space 115 in which the fusible element 105 is received and mounted is formed inside the pressure body 113. The first receiving space 115 is bounded to the outside in the radial direction R by the pressure body 113 and is closed by a closure element 104 in the axial direction, that is to say in the direction of longitudinal extent L. The installation size of the fuse housing 110 corresponds here to that of a standardized NH fuse, as described above with respect to FIG. 1. On account of the identical dimensions, the fuse 100 according to the invention is best suited for retrofit applications, that is to say as a replacement for a conventional NH fuse.

The fuse 100 has two connection elements 103, which are designed as blade contacts and which are fixedly and tightly mechanically connected to the fuse housing 110, for the purpose of electrical contact-connection. However, the design of the two connection elements 103 is not essential to the invention. Inside the fuse 100, more specifically: in the first receiving space 115, the fusible element 105 is electrically conductively connected to the two connection elements 103. If the fuse according to the invention is a fuse solidified with sand, the remaining volume of the first receiving space 115 is filled with sand, generally quartz sand, which completely surrounds the fusible element 105 and serves as extinguishing medium for extinguishing and cooling the fusible element 105 when the fuse 100 is tripped.

The second section 112 is designed as a protective body 114 which serves to receive a measuring device 120 and bounds a second receiving space 116 provided for this purpose to the outside. Since the protective body 114 only serves to receive and to fasten the measuring device 120 and to protect it against external disruptions such as moisture and/or dirt, considerably less stringent requirements are placed on the mechanical stability of the protective body 114 than on that of the pressure body 113. In this case, the protective body 114 is fixedly connected to the pressure body 113, wherein the first receiving space 115 and the second receiving space 116 are physically delimited from one another by a partition wall 117. The partition wall 117 may be a separate component; however, it is likewise possible to design the partition wall 117 as a constituent part of the pressure body 113 or of the protective body 114. The second receiving space 116 is closed by a further closure element 104 counter to the direction of longitudinal extent L. The lower connection element 103 designed as a blade contact is inserted through the second receiving space 116 into the first receiving space 115 and is electrically conductively connected there to the fusible element 105 by the further closure element 104.

The measuring device 120 has a current transformer 121 and an electronics assembly 122 which is connected to the current transformer 121. The current transformer 121 is designed in a ring-like or toroidal manner and arranged around the lower connection element 103: if a primary current flows through the fuse 100, an induction current (secondary current), the magnitude of which can be inferred from the magnitude of the primary current, is generated in the current transformer 121. These measurement values can be processed with the aid of the electronics assembly 122 connected to the current transformer 121. For this purpose, the electronics assembly 122 has a microprocessor for processing or preprocessing the ascertained measurement data. Furthermore, the electronics assembly 122 can also have a transmission device in order to transmit the measurement data or the processed data to a reception device (not illustrated)—for example a control station or a data collection device—arranged outside the fuse 100.

In order to be able to dispense with an additional energy source for the data processing transmission, the quantity of energy required for the electronics assembly 122 is likewise obtained from the secondary current generated by the current transformer 121. In order to be able to provide sufficient energy in this case, a current transformer volume that is as large as possible is required. Therefore, the current transformer 121 is designed such that its width in the radial direction R is maximized, that is to say the current transformer 121 utilizes the width of the installation space, available in the protective body 114, of the second receiving space 116 as completely as possible. In the direction of longitudinal extent L, the height of the current transformer 121 corresponds to the height of the second receiving space 116 minus the height of the electronics assembly 122. In other words: in the direction of longitudinal extent L, the second receiving space 116 is utilized as completely as possible by the current transformer 121 and the electronics assembly 122. In this way, the volume of the current transformer 121 can be optimized, that is to say can be increased in size to such an extent that reliable measurement and transmission of the measurement data can be ensured even in the case of a low primary current.

Upon close consideration of the sectional illustration shown in FIG. 3, it becomes clear that the upper connection element 103 is not arranged exactly centrally, but rather somewhat eccentrically in the pressure body 113 or in the protective body 114. This corresponds to the normal arrangement of the connection elements 103 of a conventional NH fuse, as described above in relation to FIG. 1. In order to be able to maximize the volume of the current transformer 121, the lower connection element 103 is designed to be somewhat narrower in the radial direction, so that it is arranged centrally in the second receiving space. As a result, a ring-like or toroidal current transformer 121 with a larger outside diameter than would be the case with an eccentrically arranged connection element 103 can be used.

FIGS. 4 and 5 are sectional illustrations in vertical projection. In the section, illustrated in FIG. 4, through the electronics assembly 122, it is clear that the electronics assembly 122 is adapted to the inner contour of the protective body 114 in order to in this way optimally utilize the installation space available in the second receiving space 116 for the electronics assembly 122. Furthermore, the electronics assembly 122 has an elongate hole-like opening 123 through which the lower connection element 103 is led. Given corresponding dimensioning of the opening 123, the electronics assembly 122 is secured, that is to say received and mounted, in respect of its physical position in the second receiving space in this way. Furthermore, in the section, illustrated in FIG. 5, through the current transformer 121, it is clear that the second receiving space 116 is almost completely utilized in the radial direction R owing to the central arrangement of the lower connection element 103. An extremely compact design of the measuring device can be realized in this way. In the illustrations of FIGS. 4 and 5, the inner contour of the protective body 114 is of octagonal design. However, this shaping is not essential to the invention and constitutes just one of many options; rounded cross sections or round, cylindrical shapes would likewise come into consideration for this purpose.

Figure 6:
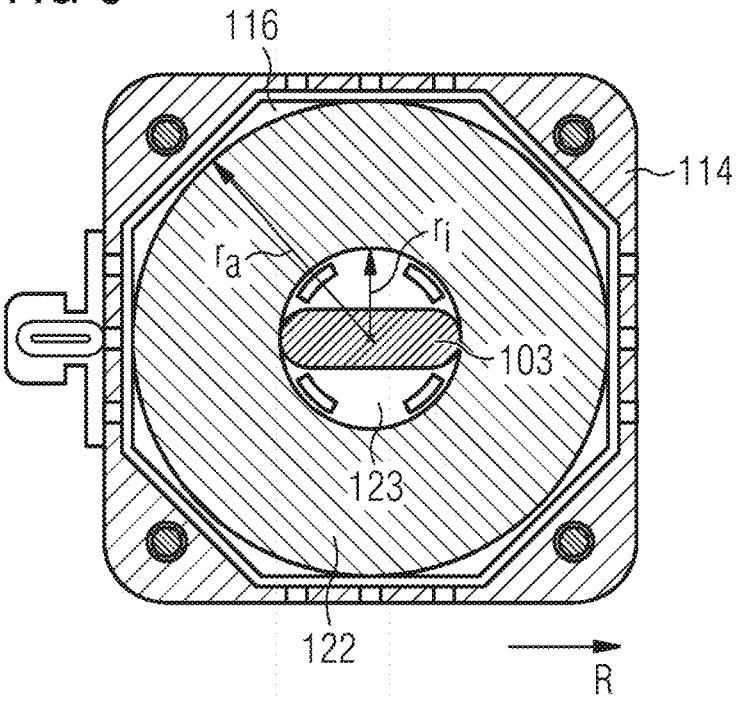
FIGS. 6 and 7 are schematic illustrations of a further example embodiment of the fuse according to the invention.
Figure 7:
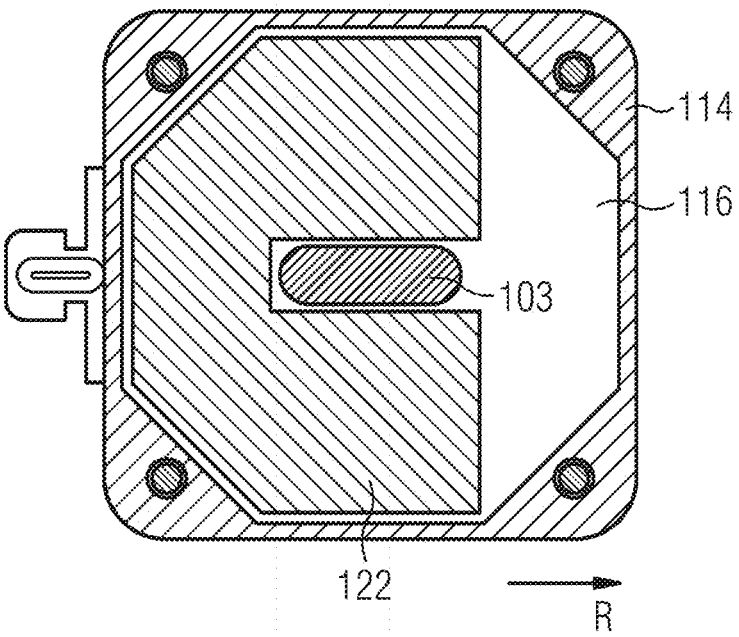

FIGS. 6 and 7 schematically illustrate two further example embodiments of the fuse 100 according to the invention. Said figures each show a sectional illustration through the electronics assembly 122 in vertical projection—corresponding to FIG. 4 of the first example embodiment. The basic construction of the fuse 100 and of the fuse housing 110 corresponds here to the first example embodiment illustrated in FIGS. 2 to 4. The main difference from the first example embodiment is the different design of the electronics assembly 122. In FIG. 6, the electronics assembly 122 is designed in a ring-like manner and therefore adapted to the shape of the current transformer 121. It has an outer radius ra and an inner radius ri through which the connection element 103 is led. The opening 123 is defined by the inner radius ri. The current transformer 121 and the electronics assembly 122 can be combined to form one structural unit which is jointly fitted, that is to say inserted and secured into the second receiving space 116 of the protective body 114.

FIG. 7 shows another embodiment of the electronics assembly 122. This is—analogously to the illustration in FIG. 4—adapted to the inner contour of the protective body 114, but not over the entire surface area. The opening 123 is designed as an open C, so that the electronics assembly 122 can be plug-mounted onto the connection element 103 from the side—that is to say in the radial direction. This example embodiment is intended to make it clear that the electronics assembly 122 does not necessarily have to take up almost all the installation space available to it; if the electronics assembly 122 can be of correspondingly compact design, it is likewise possible to fill only parts of the available installation space (as illustrated in FIG. 7). In this case, the resulting shape of the electronics assembly 122 is not essential to the invention and is illustrated, merely by way of example, as an open C.

LIST OF REFERENCE SIGNS

1 Fuse
2 Protective housing/pressure body
3 Connection element
4 Closure cap
5 Fusible element
6 Extinguishing medium/extinguishing sand
7 Row of narrow points
8 Solder deposit
100 Fuse
103 Connection element
104 Closure element
105 Fusible element
110 Fuse housing
111 First section
112 Second section
113 Pressure body
114 Protective body
115 First receiving space
116 Second receiving space
117 Partition wall
120 Measuring device
121 Current transformer
122 Electronics assembly/printed circuit board
123 Opening
$r_a$ Outer radius
$r_i$ Inner radius
L Direction of longitudinal extent
R Radial direction While the present disclosure has been described above by reference to several specific embodiments, it should be understood that embodiments of the present disclosure are not limited to the specific embodiments disclosed. Embodiments of the present disclosure are intended to cover various modifications and equivalent arrangements included within the spirit and scope of the appended claims. The scope of the claims conforms to the broadest interpretation, thus including all such modifications and equivalent structures and functions.

The invention claimed is:

1. A fuse including an integrated measuring function, comprising:
- a fuse housing, including a pressure body, the pressure body including
  - a first receiving space bounded by the pressure body and
  - a second receiving space, physically delimited from the first receiving space and bounded by a protective body, the first and second receiving spaces being arranged one behind another in a direction of longitudinal extent;
- a fusible element, accommodated and mounted in the first receiving space; and
- a measuring device, accommodated and mounted in the second receiving space, including a current transformer and an electronics assembly electrically conductively connected to the current transformer, the current transformer and the electronics assembly being arranged one behind another in the direction of longitudinal extent.

2. The fuse of claim 1, wherein the electronics assembly is arranged between the current transformer and a closure element of the fuse.

3. The fuse of claim 1, wherein the current transformer almost completely fills the second receiving space in a radial direction oriented orthogonally in relation to the direction of longitudinal extent.

4. The fuse of claim 1, wherein the electronics assembly includes a printed circuit board.

5. The fuse of claim 1, wherein the electronics assembly is designed in a disk-like manner such that height of the electronics assembly, together with a height of the current transformer, corresponds substantially to a height of the second receiving space.

6. The fuse of claim 1, wherein the electronics assembly is designed in a ring-like shape including an outer radius and an inner radius and including an opening, configured to receive a connection element of the fuse through the opening.

7. The fuse of claim 6, wherein the ring-like shape of the electronics assembly is not closed.

8. The fuse of claim 1, wherein the electronics assembly includes a transmission device to transmit a measurement signal detected by the measuring device to a reception device arranged outside the fuse.

9. The fuse of claim 8, wherein the measurement signal is transmitted by the transmission device to the reception device in a wireless manner.

10. The fuse of claim 1, wherein an overall installation space required for the fuse corresponds to an installation space of a standardized NH fuse.

11. The fuse of claim 1, further comprising:
- a fuse body having
  - a first section, designed as the pressure body bounding the first receiving space, to receive the fusible element; and a second section, designed as a protective body bounding the second receiving space, to receive the measuring device, the first receiving space and the second receiving space being arranged physically delimited from one another, one behind another in a direction of longitudinal extent in the fuse body.

12. The fuse of claim 11, wherein the fuse body is designed in one piece.

13. The fuse of claim 11, wherein the fuse body is formed from a ceramic material or a thermostable plastic.

14. The fuse of claim 11, wherein the fuse body is designed in multiple parts, and wherein the pressure body is fixedly but detachably connected to the protective body.

15. The fuse of claim 14, wherein the pressure body and the protective body are formed from different materials.

16. The fuse of claim 11, wherein the pressure body and the protective body are surrounded by an additional sleeve.

17. The fuse of claim 11, wherein the overall installation space required for the fuse corresponds to an installation space of a standardized NH fuse.

18. The fuse of claim 2, wherein the current transformer almost completely fills the second receiving space in a radial direction oriented orthogonally in relation to the direction of longitudinal extent.

19. The fuse of claim 2, wherein the electronics assembly includes a printed circuit board.

20. The fuse of claim 2, wherein the electronics assembly is designed in a disk-like manner such that height of the electronics assembly, together with a height of the current transformer, corresponds substantially to a height of the second receiving space.

21. The fuse of claim 2, further comprising:

a fuse body having a first section, designed as the pressure body bounding the first receiving space, to receive the fusible element; and a second section, designed as a protective body bounding the second receiving space, to receive the measuring device, the first receiving space and the second receiving space being arranged physically delimited from one another, one behind another in a direction of longitudinal extent in the fuse body.

22. The fuse of claim 21, wherein the fuse body is designed in one piece.

* * * * *